United States Patent [19]

Sullivan

[11] Patent Number: 4,646,654

[45] Date of Patent: Mar. 3, 1987

[54] HINGE CLAMP MECHANISM FOR DROP-LEAF TABLES

[75] Inventor: Henry F. Sullivan, Libertyville, Ill.

[73] Assignee: Navillus, Inc., Grayslake, Ill.

[21] Appl. No.: 636,819

[22] Filed: Aug. 1, 1984

[51] Int. Cl.[4] ..... A47B 1/04; A47B 1/05

[52] U.S. Cl. ..... 108/69; 108/66; 108/78

[58] Field of Search ..... 108/69, 78, 66, 70, 108/62, 65, 77, 71, 76; 16/361, 360, 239, 235

[56] References Cited

U.S. PATENT DOCUMENTS

| | | | |
|---|---|---|---|
| 134,904 | 1/1873 | Loth | 108/78 |
| 135,827 | 2/1873 | Loth | 108/78 |
| 360,788 | 4/1887 | Wilson | 108/78 |
| 637,997 | 11/1899 | Russell | 16/235 X |
| 1,490,261 | 4/1924 | Freeman | 108/78 |
| 1,641,518 | 9/1927 | Anderson | 108/78 |
| 1,662,228 | 3/1928 | Anderson | 108/78 |
| 1,709,210 | 4/1929 | Gillespie | 108/77 |
| 1,752,226 | 3/1930 | Bragg | 108/78 |
| 1,781,602 | 11/1930 | Rygl | 108/66 |
| 2,067,884 | 1/1937 | Bates | 16/360 |
| 2,815,529 | 12/1957 | Herbolsheimer et al. | 108/77 |
| 3,336,881 | 8/1967 | Aiken, Sr. | 108/77 |
| 4,301,744 | 11/1981 | Walter | 108/77 |

FOREIGN PATENT DOCUMENTS

| | | | |
|---|---|---|---|
| 581417 | 8/1959 | Canada | 108/78 |
| 1559864 | 2/1970 | Fed. Rep. of Germany | 16/360 |
| 85586 | 7/1965 | France | 108/69 |

*Primary Examiner*—Kenneth J. Dorner
*Assistant Examiner*—José V. Chen
*Attorney, Agent, or Firm*—Lockwood, Alex, FitzGibbon & Cummings

[57] ABSTRACT

A hinge-latch mechanism mounts an extension leaf to a table for movement between extended and storage positions. A pair of guide rails, mounted to the table, support a flat hinge plate for sliding movement along the undersurface of the table while an extension leaf is pivotally connected to one end of the hinge plate for rotation between the extended and storage positions. A latch mechanism is provided to lock the leaf in the extended position.

12 Claims, 26 Drawing Figures

FIG. 11a
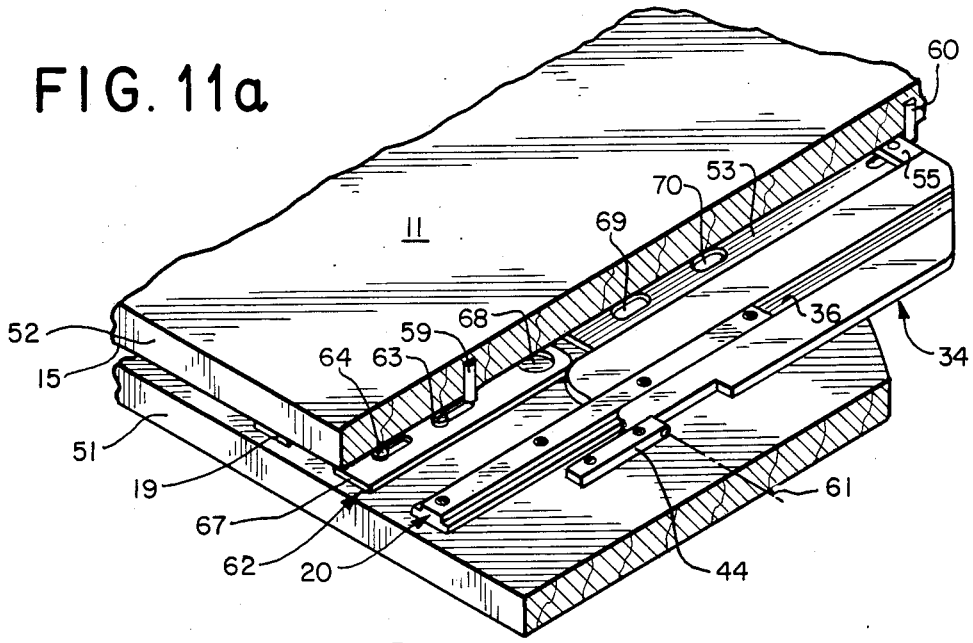
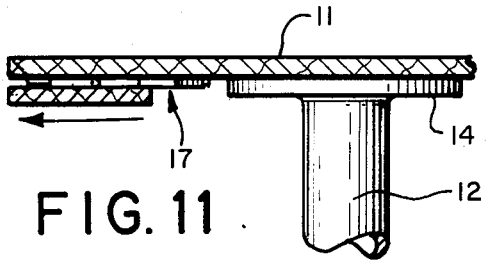
FIG. 11
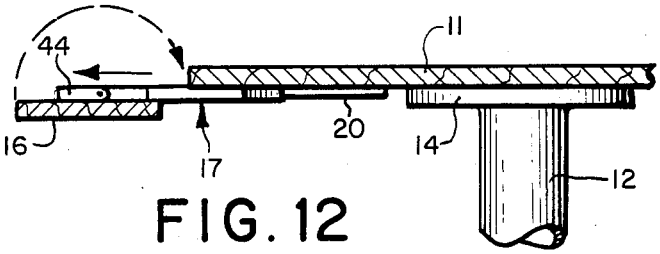
FIG. 12
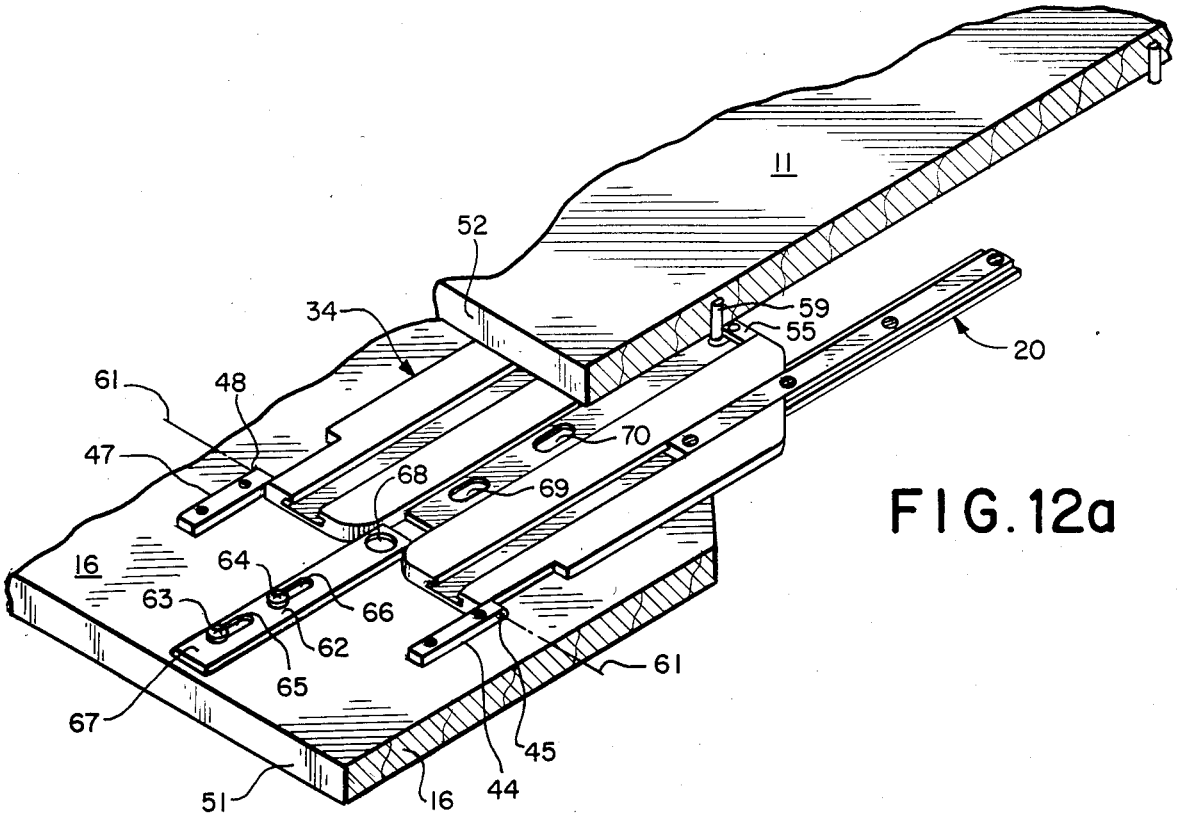
FIG. 12a

FIG. 13a
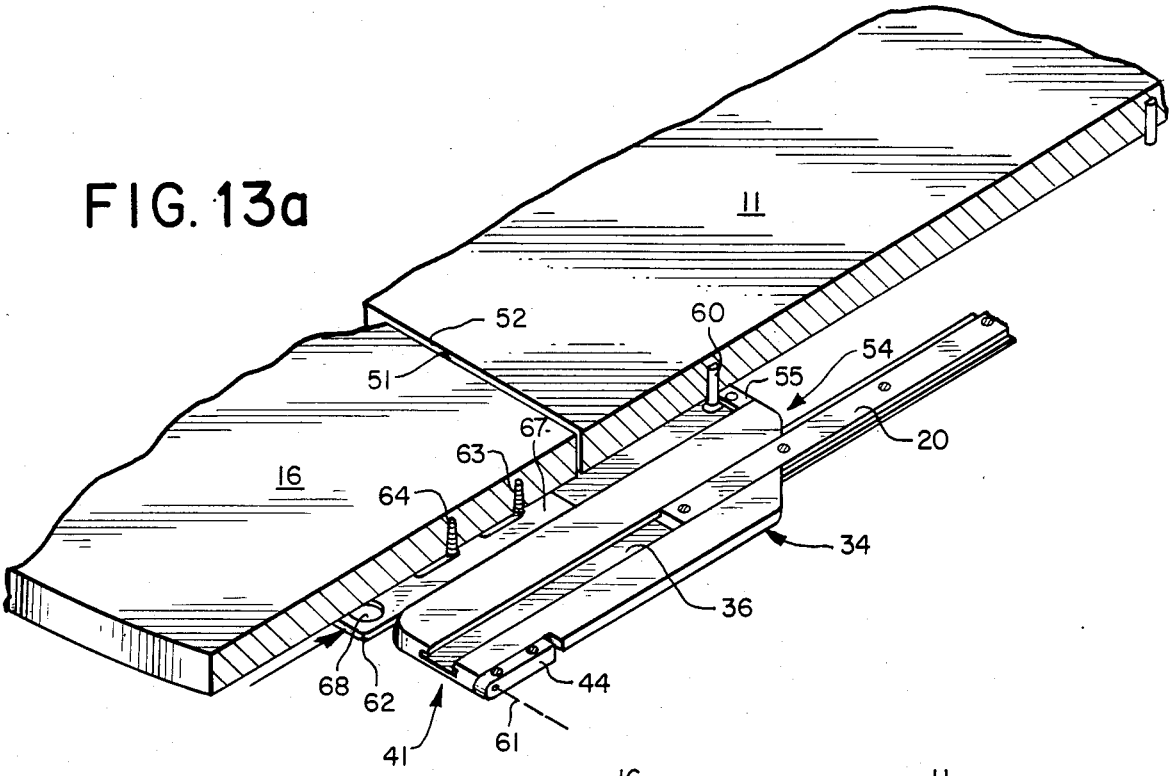
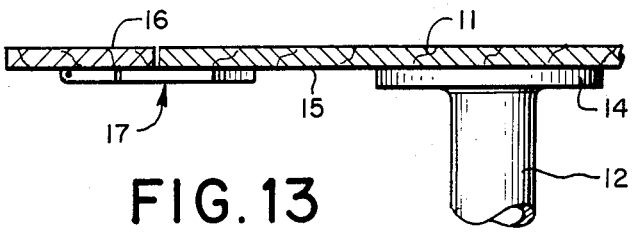
FIG. 13
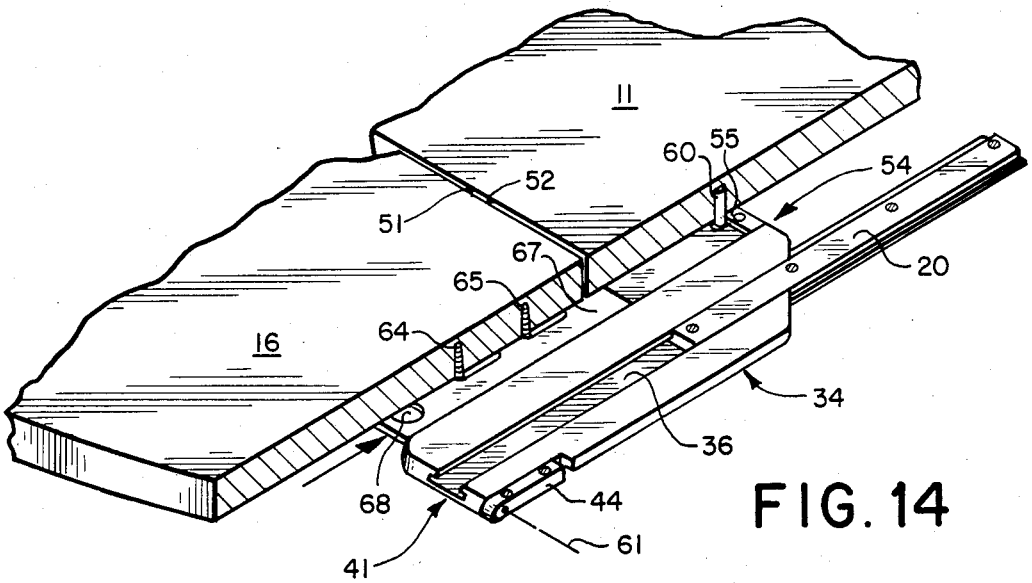
FIG. 14

HINGE CLAMP MECHANISM FOR DROP-LEAF TABLES

This invention relates generally to hinges and more particularly to a hinge-latch mechanism for pivotally connecting an extension leaf to a table or other support and clamping the leaf in either an extended or a storage position The use of extension leaves to enlarge or otherwise alter the size and shape of a table surface is a well known and common practice. Accordingly, a variety of hinge devices have been proposed for mounting such leaves to a table. Typicallly, these devices provide a pivotal attachment between the leaf and table to permit rotation of the leaf from a storage position to an extended position. Hinge-latch devices perform the additional function of clamping or locking the leaf in either of these positions to obviate the need for a separate clamp or latch mechanism.

To provide adequate support to an extended leaf, prior hinge-latch devices often projected for a considerable distance below the table surface. Aside from detracting from the appearance of the table, this frequently interfered with the comfort of people seated at the table and raised the possibility that an inadvertent bump against the mechanism could cause collapse of an extended leaf.

Another characteristic of many prior hinge-latch was that they did not permit storage of an extension leaf in a space saving position immediately below and parallel with the table surface, but rather allowed the leaf to hang vertically when not in use. This again prevented comfortable seating in the area of the leaf and thus reduced the overall versatility of the table.

In view of the foregoing, it is a general object of the present invention to provide a new and improved hinge-latch mechanism for drop leaf tables.

It is a more specific object of the present invention to provide a low-profile hinge-latch mechanism which occupies minimal space beneath the undersurface of the table.

It is a still more specific object of the present invention to provide a hinge-latch mechanism which permits storage of an unused leaf in a position beneath and parallel with the undersurface of the table.

The present invention is directed to a low-profile hinge-latch mechanism for attaching an extension leaf to a table top or other support member. The mechanism includes one or more guide rails mounted to the undersurface of the table and a rigid hinge plate mounted for sliding movement on the rail along the undersurface of the table. A pivot assembly at one end of the hinge plate is attached to the extension leaf and permits pivotal movement of the leaf from a first position above and substantially parallel to the hinge plate to a second position below and substantially parallel to the hinge plate. When the extension leaf is in the second position, the hinge plate can be positioned fully beneath the table surface to store the extension leaf when it is not in use. To position the extention leaf for use, the hinge plate is partially withdrawn from beneath the table surface, and the extension leaf is rotated to the first position. A latching mechanism may be provided as part of the hinge mechanism to maintain the extended leaf in the first position.

The features of the present invention which are believed to be novel are set forth with particularity in the appended claims. The invention, together with further advantages thereof, can best be understood by reference to the following description taken in conjunction with the accompanying drawings and the several figures, in which like reference numerals identify like elements, and in which:

Figures 10, 10A:
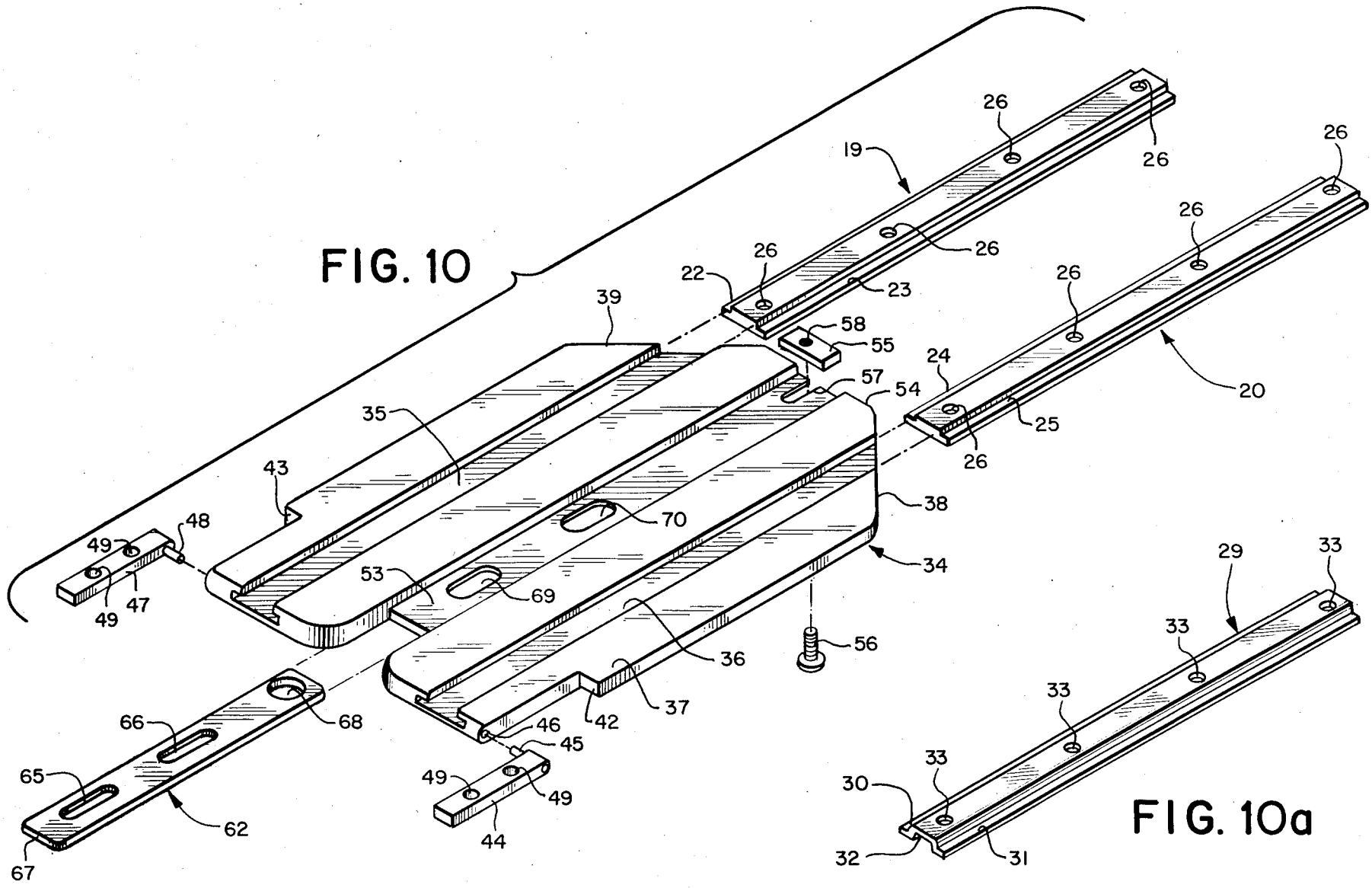
FIG. 10 is an exploded perspective view of the hinge-latch mechanism showing the principal components thereof.

FIG. 10*a* is a perspective view of an alternate form of guide rail for use in the hinge-latch mechanism.

Figure 1:
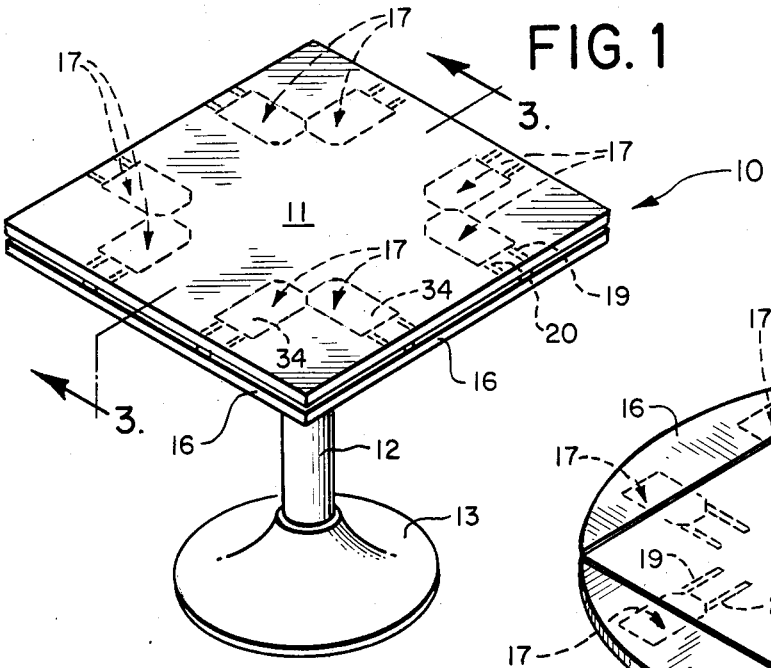
FIG. 1 is a perspective view of a drop leaf table having hinge-latch devices constructed in accordance with the invention, showing the extension leaves in a storage position.

FIG. 11 is a fragmentary side view, partially in section, of the table illustrated in FIG. 1 showing the extension leaf being withdrawn from the storage position FIG. 11*a* is a perspective view, partially in section, of the hinge-latch mechanism showing the extension leaf in the storage position.

FIG. 12 is a fragmentary side elevational view, partially in section and similar to FIG. 11, showing the withdrawn extension leaf being rotated to the extended position.

FIG. 12*a* is a fragmentary perspective view, similar to FIG. 11*a*, showing the hinge-latch mechanism in a fully withdrawn position.

FIG. 13 is a fragmentary side elevational view, partially in section, similar to FIG. 12, showing the extension leaf in the extended position.

FIG. 13*a* is a fragmentary perspective view, partially in section, showing the extension leaf in an extended position and the hinge-latch mechanism in an unlatched condition.

FIG. 14 is a fragmentary perspective view, partially in section and similar to FIG. 13*a*, showing the hinge-latch mechanism in a latched condition.

Figure 15:
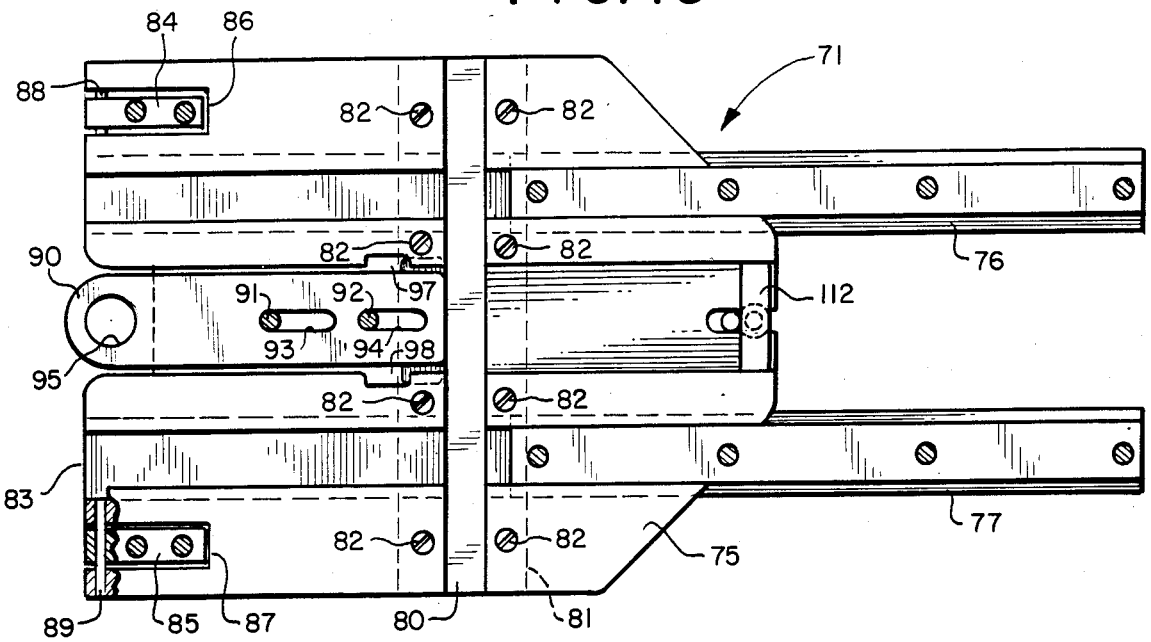

FIG. 15 is a top plan view of an alternate embodiment of a hinge-latch mechanism constructed in accordance with the invention.

Figure 16:
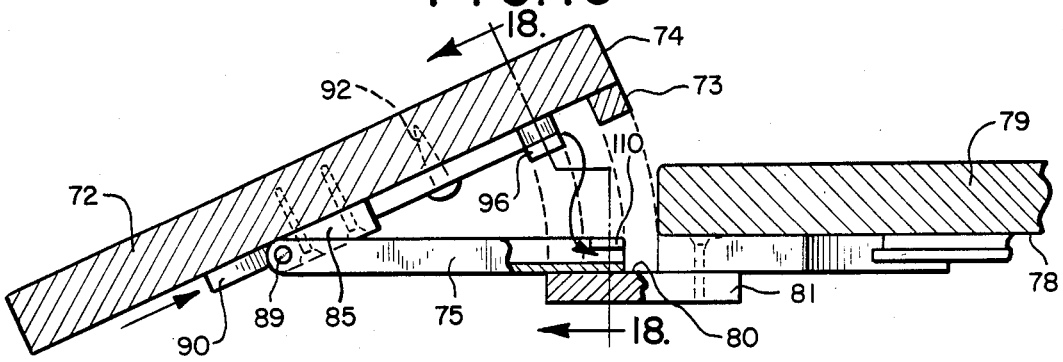

FIG. 16 is a side elevational view, partially in section, of the hinge-latch mechanism shown in FIG. 15, showing an extension leaf in an intermediate position.

Figure 17:
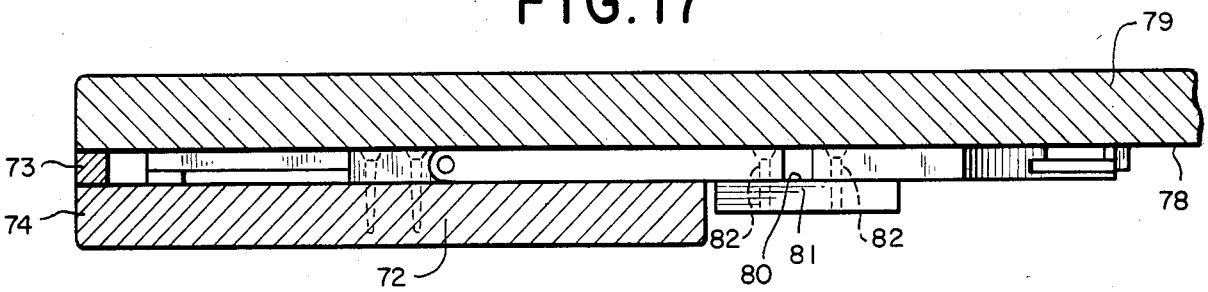

FIG. 17 is a side elevational view, similar to FIG. 16, showing the extension leaf in a storage position.

Figure 18:
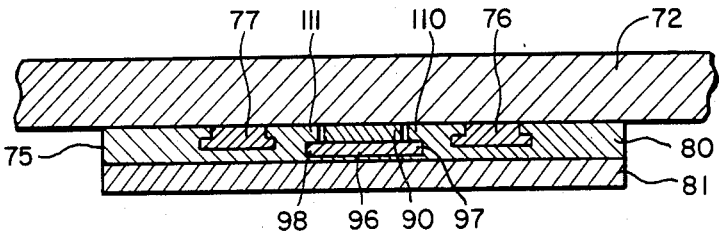

FIG. 18 is a cross sectional view of the hinge-latch mechanism shown in FIG. 16 taken along line 18—18 thereof.

Figure 19:
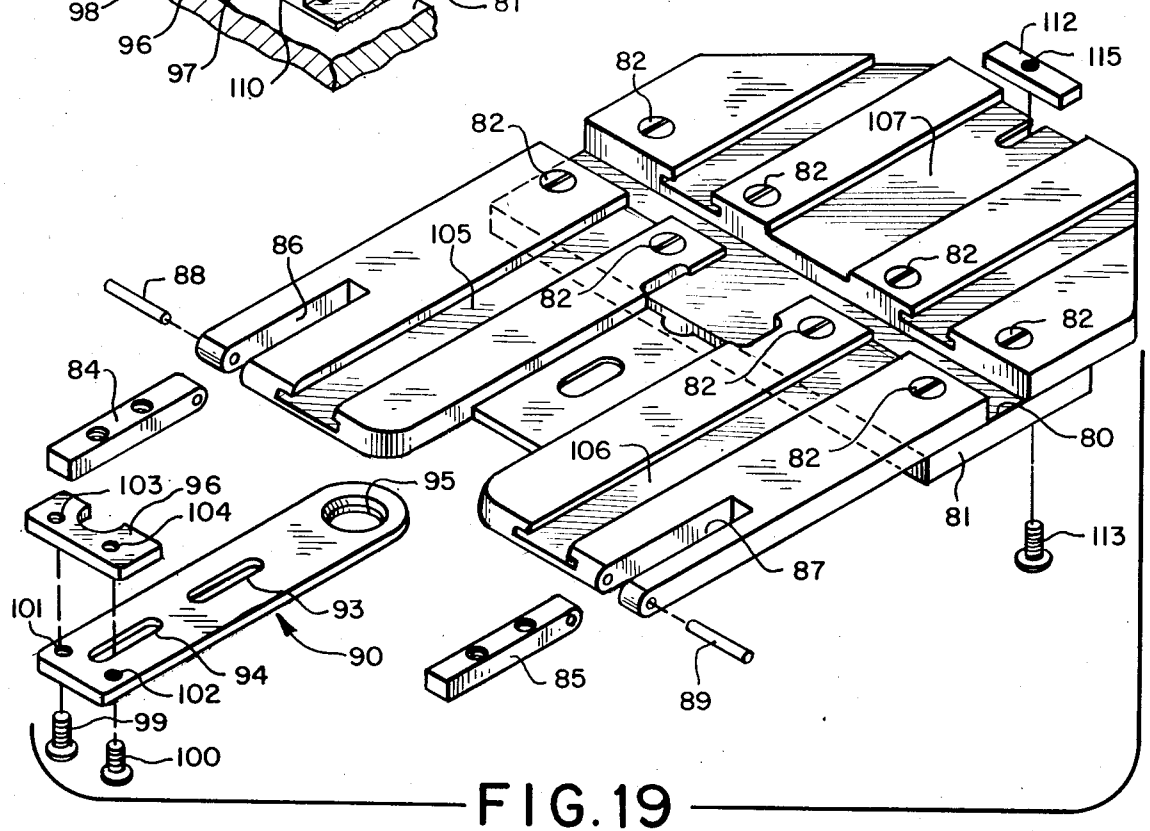

FIG. 19 is an exploded perspective view of the alternate embodiment shown in FIG. 15, showing the principal components thereof.

Figure 20:
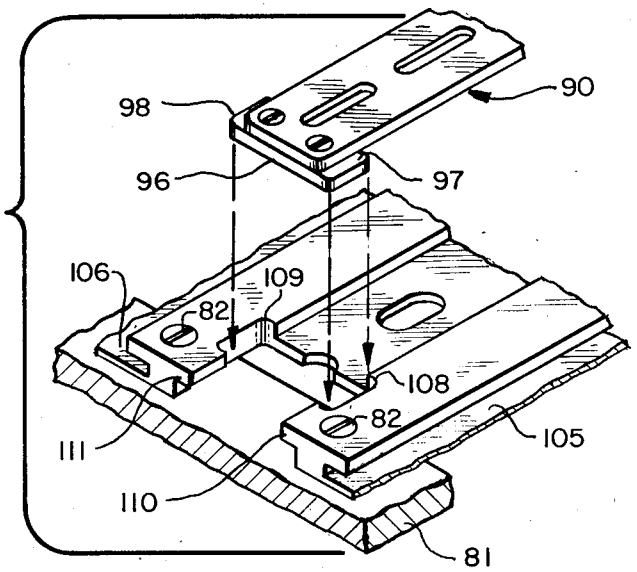

FIG. 20 is an exploded fragmentary perspective view of the latch mechanism of the hinge-latch shown in FIG. 19.

Figure 20A:
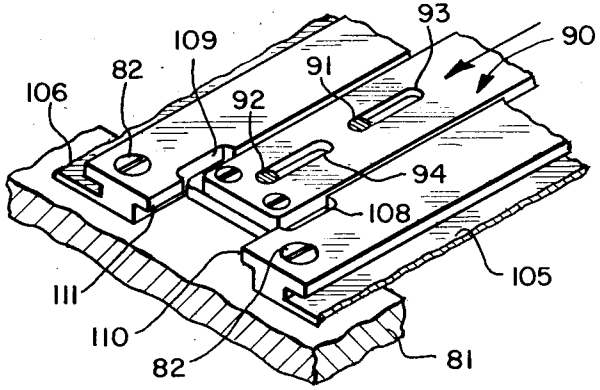

FIG. 20*a* is a fragmentary perspective view, similar to FIG. 20, showing the latch mechanism in an unlatched position.

Figure 20B:
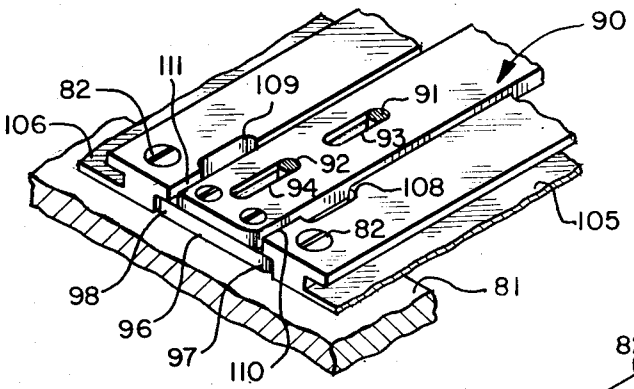

FIG. 20*b* is a fragmentary perspective view similar to FIG. 20*a*, showing the latch mechanism in a latched condition.

Referring to the drawings, and in particular to FIGS. 1–4, a drop leaf table 10 incorporating a plurality of hinge-latch devices constructed in accordance with the invention is illustrated. The table includes a generally square top 11, supported on a centrally disposed pedestal 12 having a generally circular flared foot 13 at the end adjacent the floor. At its other end, pedestal 12 includes a circular flange 14 for attachment to the undersurface 15 of table top 11. To convert the table into a circular table having an increased seating capacity, an arcuate extension leaf 16 is connected to each of the four edges of table top 11 by means of a plurality of hinge-latches 17 constructed in accordance with the invention and arranged in pairs at each edge of top 11.

Figure 4:
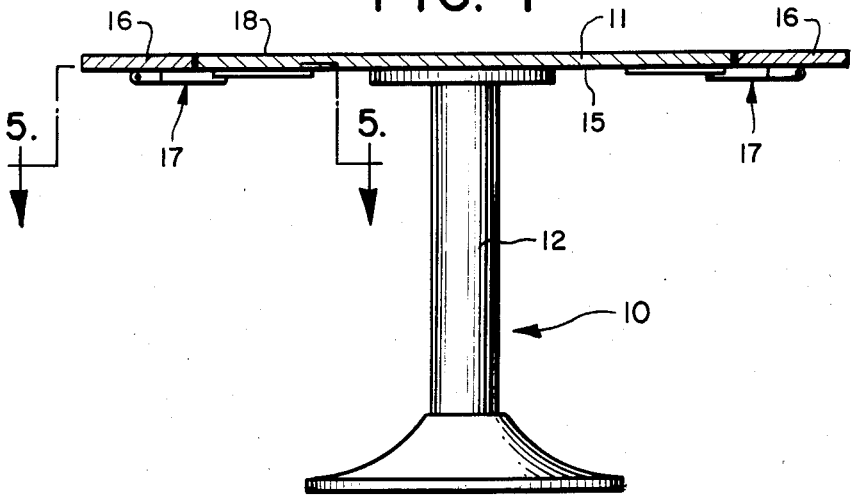
FIG. 4 is a side elevational view, partially in section, of the table shown in FIG. 2 taken along line 4-4 thereof.

Hinge-latches connect leaves 16 to the edges of the table for movement between a reversely folded storage position against the undersurface 15 of top 11 (FIG. 3) and an extended position substantially coplanar with, the upper surface 18 of top 11 (FIG. 4). Hinge-latches 17 serve the additional function of firmly retaining the extension leaves 16 in either of the storage or extended positions. As will be apparent by reference to FIGS. 3 and 4, the hinge-latches 17, together with extension leaves 16, project only slightly beneath the undersurface 15 of table top 11 whether the leaves are in the storage or extended positions.

The basic structure of each hinge-latch 17 is most clearly shown in FIGS. 5–10. A pair of guide rails 19 and 20 are mounted in parallel spaced relation to the undersurface of table top 11 by means of a plurality of fasteners such as, for example, flat head wood screws 21. Each guide rail preferably comprises a metallic extrusion having a substantially T-shaped cross section as shown in FIG. 10. As a result of this cross sectional shape, a pair of horizontal ledges 22 and 23 are formed on opposite sides of guide rail 19, while a similar pair of ledges, 24 and 25, are formed on opposite sides of guide rail 20. To provide clearance for the screw fasteners 21, a plurality of apertures 26 through guide rails 19 and 20 are disposed along the midline of each. Guide rails 19 and 20 are positioned with their relatively narrow faces 27 and 28 respectively against the undersurface 15 of table top 11, leaving a vertical gap between undersurface 15 and each of the guide rail ledges 22–25.

FIG. 10*a* illustrates an alternate form of guide rail 29 which may be used in place of guide rail 19 or 20. In contrast to extruded guide rails 19 and 20, alternate guide rail 29 comprises a sheet metal stamping and is shaped as to facilitate economical manufacture by that method. Accordingly, guide rail 29 comprises a generally U-shaped member having outwardly turned ends which form flanges 30 and 31 corresponding to the respective ledges of guide rails 19 and 20. A channel 32 extends along the length of guide rail 29, while a plurality of apertures 33 along the midline thereof permit the guide rail to be fastened to the undersurface 15 of table top 11 by means of a plurality of fasteners such as, for example, wood screws. In contrast to guide rails 19 and 20 which require the use of flat head screw fasteners to avoid having the fasteners project beyond the lower surface of the rails, guide rail 29, by virtue of channel 32, permits the use of round head wood screws to fasten the rail to table top 11.

Hinge clamp 17 further includes a generally flat hinge plate 34 adapted for sliding movement on guide rails 19 and 20 along the undersurface 15 of table top 11. Hinge plate 34 preferably comprises a metallic extrusion having a generally rectangular shape. A pair of channels 35 and 36, each having a generally T-shaped cross section, are formed in parallel spaced relation in the upper surface 37 of hinge plate 34, and are dimensioned to slidably receive guide rails 19 and 20 respectively. The thickness of hinge plate 34 and the depth of channels 35 and 36 are such that sufficient clearance between the upper surface 37 of hinge plate 34 and the undersurface 15 of table top 11 is provided as to permit sliding movement of the hinge plate 34 along rails 19 and 20.

Figure 2:
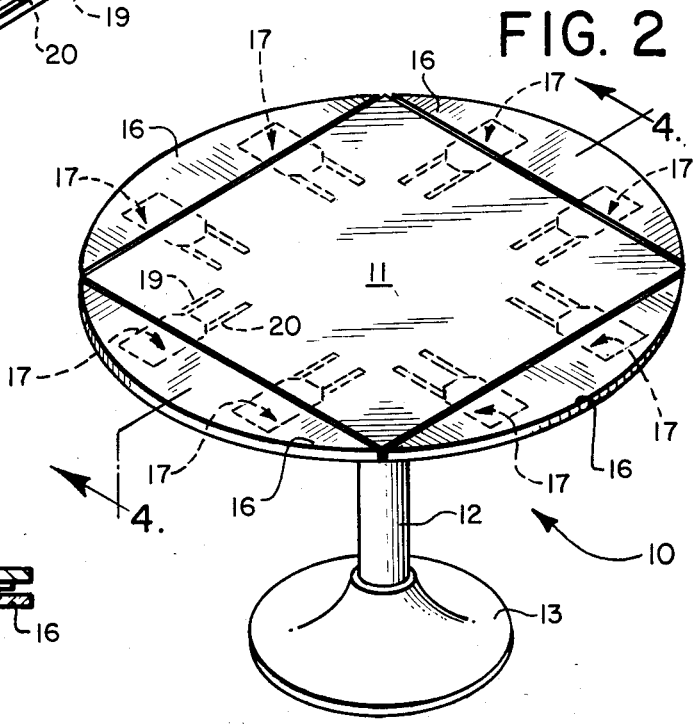
FIG. 2 is a perspective view of the table shown in FIG. 1 showing the extension leaves in an extended position.
Figure 3:
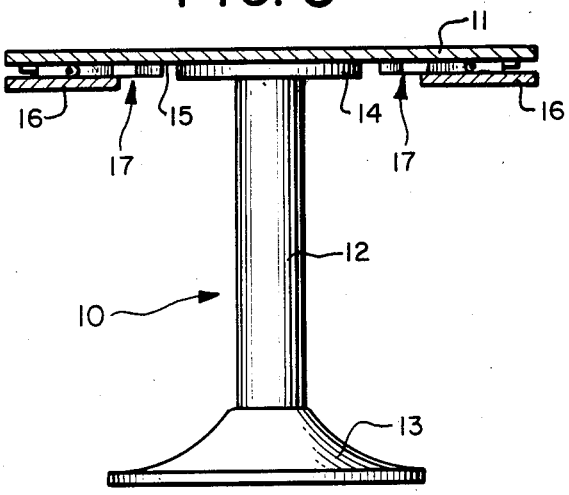
FIG. 3 is a side elevational view, partially in section of the table shown in FIG. 1 taken along line 3—3 thereof.

As shown in FIGS. 1 and 2, the guide rails 19 and 20 are oriented generally perpendicular to the edge of the top. To avoid interference between adjacent hinge plates at the corners of the table, the inward corners 38 and 39 of hinge plate 34 (FIGS. 5 and 10) are beveled permitting adjacent hinge plates to nest with one another when the leaves are in the storage position shown in FIG. 1.

Figure 5:
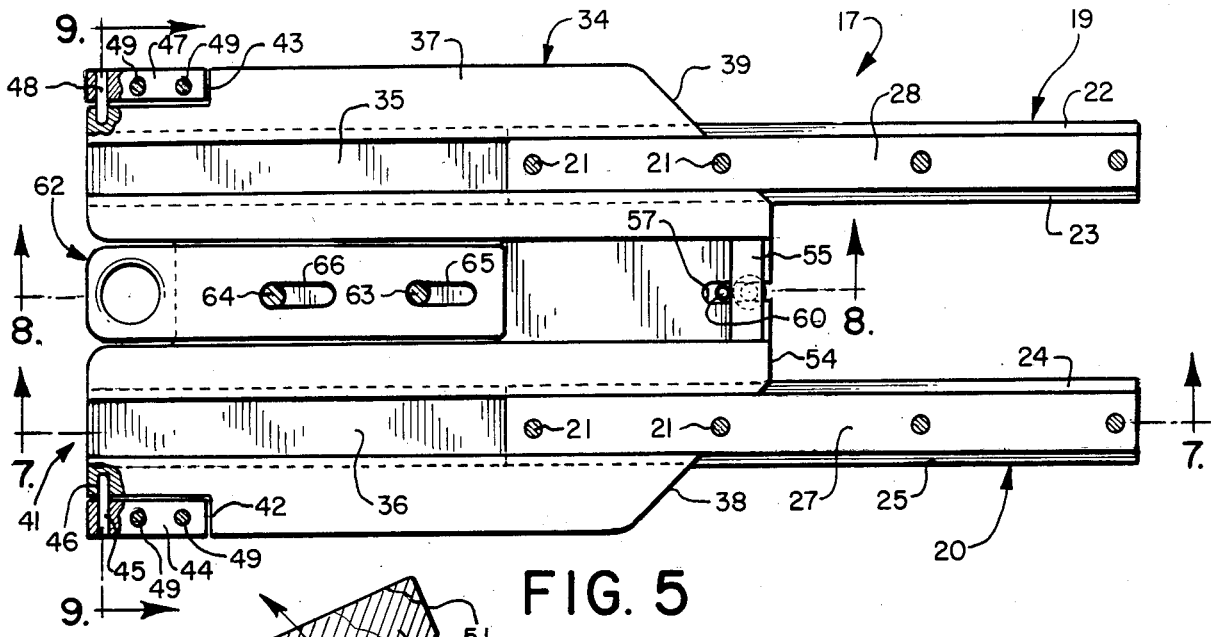
FIG. 5 is a cross sectional view of the table illustrated in FIG. 4 taken along line 5—5 thereof, showing the principal elements of the hinge-latch mechanism constructed in accordance with the invention.
Figure 6:
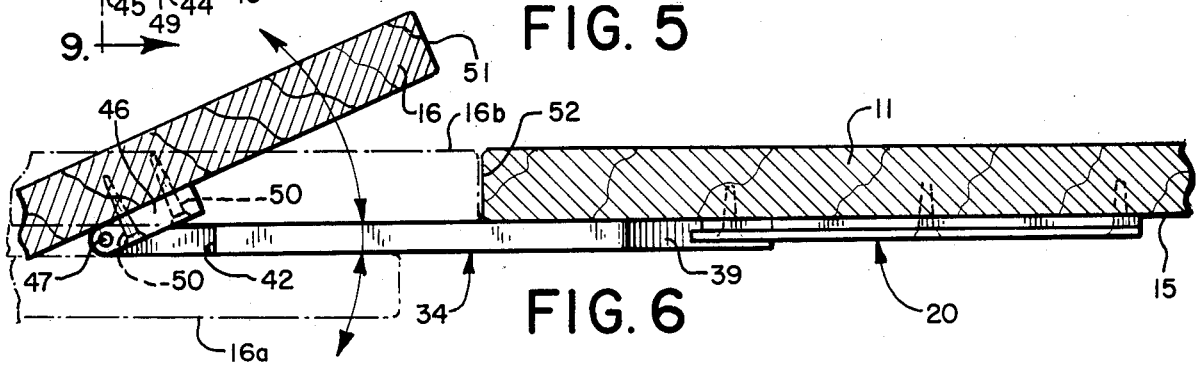
FIG. 6 is a side elevational view, partially in section of the hinge-latch mechanism mounted to a table with the leaf shown in extended, storage and intermediate positions.

At the distal end 41 of hinge plate 34, a pivot assembly is provided for attachment to extension leaf 16 to permit pivotal movement of the extension leaf relative to the hinge plate as shown by the arrows in FIG. 6. To this end, the corners at distal end 41 are partially cut away to form a pair of generally rectangular notches 42 and 43 (FIG. 5). An elongated, generally square cross sectioned hinge bar 44, is dimensioned to be received within notch 42, and is pivotably mounted to hinge plate 34 by means of a hinge pin 45 extending through the bar and into a recess 46 formed in the sidewall of the notch. A similar hinge bar 47 is pivotably mounted within notch 43 by means of a second hinge pin 48. A pair of apertures 49 are formed through each hinge bar 44 and 47 in the direction perpendicular to the upper surface 37 of hinge plate 34 and allow the hinge bars to be affixed to the undersurface of extension leaf 16 by means of flat head wood screws 50 (FIG. 6) or similar fasteners.

As shown in FIG. 6, the pivot assembly permits rotation of extension leaf 16 from a storage position 16*a*, wherein the leaf is beneath and substantially parallel with hinge plate 34, through substantially 180° of arc, to an extended position 16*b*, wherein the leaf is above and substantially parallel with the hinge plate. When the extension leaf is in the extended position, hinge bars 44 and 47 are fully received in respective notches 42 and 43. As further illustrated in FIGS. 6–8, the straight edge 51 of extension leaf 16 abuts the edge 52 of table top 11 when the leaf is fully extended.

Figure 7:
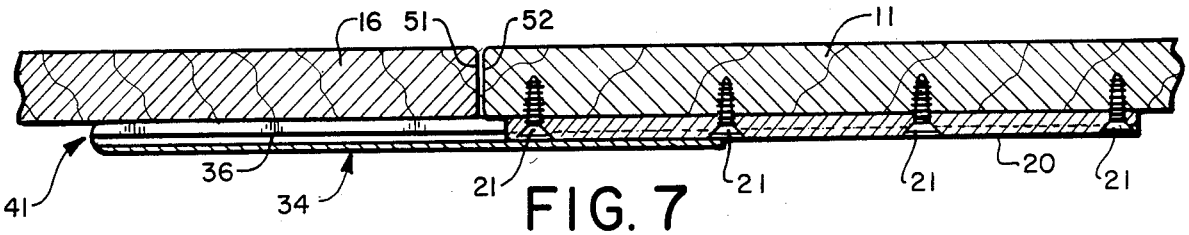
FIG. 7 is a cross sectional view of the hinge-latch mechanism shown in FIG. 5 taken along line 7—7 thereof.
Figure 8:
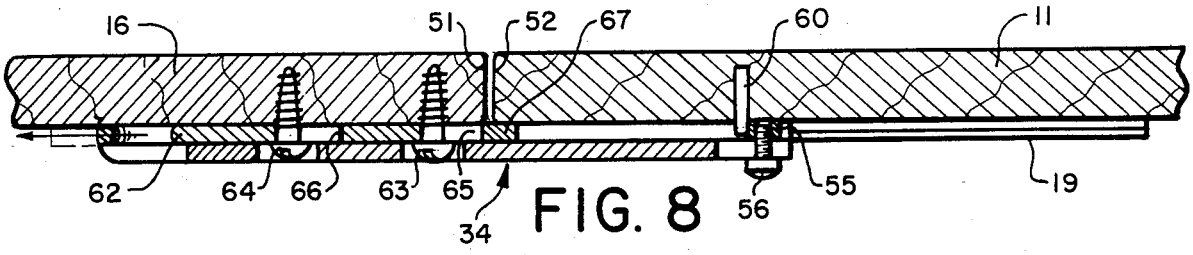
FIG. 8 is a cross sectional view of the hinge-latch mechanism shown in FIG. 5 taken along line 8—8 thereof.
Figure 9:
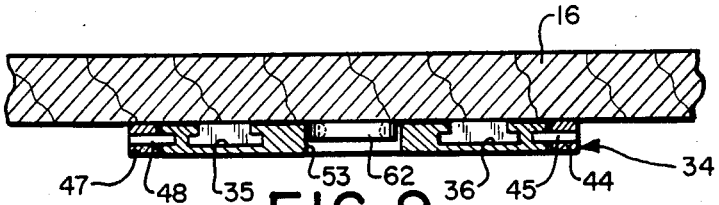
FIG. 9 is a cross sectional view of the hinge-latch mechanism shown in FIG. 5 taken along line 9—9 thereof.

When the leaf is fully extended as illustrated in FIGS. 7 and 8, the hinge plate 34 is positioned along rails 19 and 20 so that the distal end 41 of the plate projects beyond edge 52 of the table. The maximum distance by which end 41 projects beyond edge 52 is carefully controlled to minimize any gap between edges 51 and 52. To this end, a stop is provided for limiting movement of the hinge plate along the guide rails.

Referring to FIGS. 10–12*a*, the upper surface 37 of hinge plate 34 is provided with a generally rectangular sectioned channel 53 extending the length of the hinge plate along the midline thereof. At the proximate end 54 of the hinge plate, an elongated, generally rectangular, stop member 55 is transversely disposed within channel 53. The stop member is held in position by means of a machine screw 56 which projects upwardly through a slot 57 in the hinge plate and engages a centrally disposed, threaded aperture 58 therein. Since slot 57 is elongated, the position of the stop member along channel 53 can be adjusted over a range.

As shown in FIGS. 11*a* and 12*a*, a pair of vertically oriented stop pins 59 and 60 are mounted to table top 11 along a line midway between guide rails 19 and 20. Each of the stop pins projects downwardly from the undersurface 15 of table top 11. Forward pin 59, adjacent edge 52 of top 11, extends into the region defined by channel 53 in hinge plate 34. Accordingly, movement of the hinge plate along the guide rails beyond edge 52 is limited by reason of forward stop pin 59 engaging stop member 55 as shown in FIG. 12*a*. The maximum distance over which hinge plate 34 projects beyond edge 52 is thus limited and can be adjusted over a range by adjusting the position of stop member 55. Preferably, this distance is adjusted as to closely match the distance between edge 51 of extension leaf 16 and the rotational axis 61 established by hinge pins 45 and 48. When so adjusted, edge 51 will abut edge 52 when leaf 16 is extended.

Rear stop pin 60 limits inward movement of hinge plate 34 along the guide rails as shown in FIG. 11*a*. Preferably, stop pin 60 is located so that when it is contacted by stop member 55, edges 51 and 52 will be aligned as shown. When the extension leaf is in the storage position, rotation of the leaf about axis 61 is prevented by reason of the elongated hinge bars 44 and 47 engaging the undersurface 15 of the top. Accordingly, no additional means are required to maintain the leaf in the storage position.

To lock the extension leaf in the extended position, a latch mechanism is provided. This mechanism comprises an elongated latch bar 62 of rectangular cross section, which is dimensioned to be slidably receivable in channel 53 of the hinge plate 34. The latch bar 62 is affixed to the undersurface of extension leaf 16 by means of a pair of screw fasteners 63 and 64 inserted through elongated slots 65 and 66 formed in the latch bar along the midline thereof. When installed, screws 63 and 64 are not tightened, but rather, are left somewhat loose so that the latch bar 62 can slide along extension leaf 16 over a range limited by the length of slots 65 and 66. At one end of this range, the leading edge 67 of the latch bar 62 protrudes beyond edge 51 of the extension leaf, while at the other limit, the latch bar lies fully to one side of edge 51.

The operation of the latch mechanism may be understood by reference to FIGS. 13*a* and 14. When the extension leaf is first rotated to the extended position, latch bar 62 is received in channel 53 of the hinge plate. The latch bar is pulled against screws 63 and 64 so that the leading edge 67 of the bar does not extend beyond edge 51 of the extension leaf. Once the leaf has been rotated to the extended position, the latch bar 62 is moved in a direction toward table top 11 as shown by the arrows in FIGS. 13*a* and 14. This causes the leading edge 67 of the bar to protrude beyond extension leaf edge 51 and partially under the undersurface of the table top 11 to prevent reverse rotation of the extension leaf. To avoid wear, a protective plate (not shown) can be provided between latch bar edge 67 and surface 15. A finger hole 68 is provided at the end opposite leading edge 67 to facilitate user manipulation of the latch bar 62. When latched, the extension leaf 16 is clamped firmly to the extended position shown in FIG. 13. To firmly support the extension leaf, hinge plate 34 preferably straddles edges 51 and 52 as shown in FIG. 13.

To facilitate installation of the latch bar 62 on the undersurface of extension leaf 16, a pair of apertures 69 and 70 are provided through the lower surface of channel 53 and are located as to expose the heads of screws 63 and 64 when the extension leaf is in the fully extended position.

To place the extension leaf in the extended position, the leaf, together with the hinge plate, is pulled outwardly from beneath the table top in the direction shown by the arrow in FIG. 11. After verifying that the latch bar does not protrude beyond the edge 51 of the extension leaf, the leaf is next rotated through substantially 180° of arc, as shown in FIG. 12, to lie substantially coplanar with table top 11. Finally, the latch bar is moved toward the table top to firmly lock the extension leaf in position. To place the extension leaf in the storage position, this procedure is simply reversed.

An alternate embodiment of the hinge-latch is shown in FIGS. 15–20*a*. In this embodiment, the hinge-latch 71 is adapted for use with an extension leaf 72 having a lip 73 at one edge 74 for concealing the hinge-latch device when the leaf is in the storage position.

The hinge-latch mechanism 71 includes a generally flat hinge plate 75 mounted for slidable movement along a pair of spaced, parallel, guide rails 76 and 77, affixed to the undersurface 78 of a table top 79. Hinge plate 75 is provided with a transverse channel 80 extending across the plate in a direction generally perpendicular to guide rails 76 and 77. As best seen in FIG. 17, channel 80 is of generally square cross section and is positioned and dimensioned as to receive lip 73 when extension leaf 72 is rotated to the extended position.

To form channel 80, hinge plate 75 can first be formed as a single unit and then cut into two pieces along a line perpendicular to guide rails 76 and 77. The two pieces can then be attached in spaced relation to a generally rectangular plate 81 by means of a plurality of screw fasteners 82. The advantage of this construction is that hinge plate 75 may be extrusion formed to reduce manufacturing costs. As best seen in FIG. 17, lip 73 of extension leaf 72 abuts lower surface 78 of table top 79 to avoid a visible gap between the top and the leaf and thereby provide an aesthetically pleasing appearance.

To provide a more rugged pivot assembly at the distal end 83 of the hinge plate 75, hinge bars 84 and 85 are each received in respective slots 86 and 87 formed in the hinge plate, and are pivotally mounted thereto by means of hinge pins 88 and 89. Because hinge pins 88 and 89 are each supported at both ends, a somewhat sturdier construction than that shown in FIG. 5 is provided.

Lip 73 of extension leaf 72 prevents the passage of a latch bar beyond edge 74. Accordingly, the latching mechanism for locking the extension leaf in the extended position is modified in the construction shown in FIG. 15. A latch bar 90 is mounted to the undersurface of leaf 72 by means of screws 91 and 92, and is slidable relative thereto along a path determined by elongated slots 93 and 94 formed along the midline thereof. A generally circular aperture 95 is formed at one end of the latch bar to facilitate user manipulation of the latch mechanism.

At the other end of latch bar 90, a generally rectangular member 96 is mounted transverse to the bar to form a tab 97 and 98 on either side thereof as best seen in FIG. 20. Member 96 is fastened to latch bar 90 by means of a pair of machine screws 99 and 100 extending through apertures 101 and 102 in the latch bar 90, and received in tapped recesses 103 and 104 formed in member 96 (FIG. 19).

The upper surface of hinge plate 75 is provided with a pair of parallel channels 105 and 106 for slidably receiving guide rails 76 and 77 respectively, and is further provided with a center channel 107 of rectangular cross section midway between, and parallel with channels 105 and 106.

Channel 107 is dimensioned to receive latch bar 90 when the extension leaf is rotated to the extended position. To provide clearance for tabs 97 and 98 when the extension leaf is rotated, channel 107 includes a pair of notches 108 and 109 which receive tabs 97 and 98 respectively to permit latch bar 90 to fit flush with hinge plate 75. Immediately forward of notches 108 and 109, the sidewalls of channel 107 are undercut to form a pair of opposed engaging tabs 110 and 111 which overlie tabs 97 and 98 when the latch bar is pushed forward to the position shown in FIG. 20*b*. This locks the latch bar against angular, separating movement relative to hinge plate 75 and thus prevents further rotation of the extension leaf in either direction. To release the latch mechanism, the latch bar is withdrawn to the position shown in FIG. 20*a*.

At the end of channel 107, an elongated, generally rectangular stop member 112 is transversely mounted by means of a machine screw 113. The screw extends through an elongated slot 114 and is received in a tapped recess 115 provided adjacent the center of the stop member. Slot 114 permits the position of the stop member to be adjusted. This stop member cooperates with a pair of stop pins (not shown) as in the previously described embodiment.

While particular embodiments of the hinge-latches device have been shown and described, it will be apparent that modifications may be made without departing from the scope of the invention in its broader aspects. For example, the hinge plate, while preferably having the general shape shown, may be of different shape and proportion. Similarly, the hinge plate may be adapted to slide along a single guide rail, or may include more than the two guide rails shown. The hinge bars may be pivotably mounted to the hinge plate by a variety of means other than the hinge pins shown. Finally, the latching mechanisms can differ in size, shape, and operation from those shown without departing from the scope of the invention.

While the foregoing specification sets forth various embodiments of the present invention in detail, it will be appreciated that modifications thereto may be made without departing from the spirit and scope thereof. Accordingly, only such limitations are to be imposed on this invention as are indicated in the appended claims.

I claim:

1. A hinge-latch assembly for mounting an extension leaf to a support and for retaining the extension leaf in predetermined orientations relative to the support, comprising, in combination:

a generally planar hinge plate, a support and extension leaf, said generally planar hinge plate and extension leaf having respective upper and lower surfaces;

means for mounting said hinge plate to the support for movement between an extended position, wherein a portion of said hinge plate extends beyond an edge of support, and a retracted position wherein said portion does not extend beyond the edge of the support;

said mounting means including a guide rail mountable on the support, and said upper surface of said hinge plate including a channel for receiving said guide rail;

pivot means, a first portion of said pivot means including mounting means rotatably connected to said hinge plate and a second portion of said pivot means being mounted to the extension leaf to provide pivtoal movement of the extension leaf between a first orientation wherein said lower surface of said extension leaf is above and substantially parallel to said upper surface of said hinge plate and a second orientation wherein said lower surface of said extension leaf is beneath and substantially parallel to said lower surface of said hinge plate, whereby the extension leaf is maintained in said second orientation when said hinge plate is in said retracted position;

said pivot means including an elongated hinge bar mounted to said hinge plate, said elongated hinge bar being rotatable about an axis which is located between the upper and lower surfaces of said hinge plate and transverse to at least one of said upper and lower surfaces of said hinge plate; and said hinge bar rotates from one substantially co-planar position relative to said hinge plate to another substantially co-planar position when the extension leaf is pivoted from said first orientation to said second orientation.

2. A hinge-latch assembly as defined in clam 1 wherein said hinge bar rotates through substantially 180° of arc between said one co-planar position and said other co-planar position.

3. A hinge-latch assembly as defined in claim 2 wherein said hinge bar is mounted on said portion of said hinge plate which extends beyond the edge of the support when said hinge plate is in said extended position such that said hinge bar is rotatable when said hinge plate is in said extended position, and such that said hinge bar engages the support to maintain said hinge bar in one of said co-planar positions when said hinge plate is in said retracted position.

4. A hinge-latch assembly for mounting an extension leaf to a support member, said extension leaf and support member having respective upper and lower surfaces, said assembly enabling selective retention of the extension leaf in a storage position beneath and parallel to the lower surface of the support member or in an extended position wherein the upper marginal adjacent portions of the surfaces of the support member and extension leaf are in substantially the same plane, said hinge-latch assembly comprising:

an elongate guide rail;

means for mounting said guide rail to the lower surface of a support member;

a generally flat hinge plate slidably mounted on said guide rail for movement along the lower surface of the support member between a retracted position and a non-retracted position, wherein said end of said hinge plate does not project beyond an edge of the support member when said support member is in a retracted position and does project beyond an edge of said support member when said support member is in a non-retracted position, said hinge plate having a channel for receiving said guide rail therein;

pivot means, a first portion of said pivot means being rotatably mounted to said hinge plate and a second portion of said pivot means being mountable to an extension leaf, to permit pivotal movement of the extention leaf through substantially 180° of arc relative to said hinge plate, whereby the extension leaf is maintained in said storage position when said hinge plate is in said retracted position;

pivot means which include an elongate hinge bar mounted to said hinge plate for rotation in a plane oriented substantially perpendicularly to the plane of said hinge plate;

said hinge bar being rotatable from one position, substantially co-planar with said plate to another position substantially co-planar with said hinge plate to pivot the extension leaf from said storage position to said extended position; and latching means for selectively retaining the extension leaf in said extended position.

5. A hinge-latch assembly as defined in claim 4 wherein said pivot means include a pair of said hinge bars.

6. A hinge-latch assembly as defined in claim 5 wherein said latching means include an elongate latch bar adapted for mounting to the extension leaf for sliding movement relative thereto between a latched position, in which a portion of said latch bar extends under and engages the lower surface of the support member, and an unlatched position, wherein said latch bar does not extend under the lower surface of the support member.

7. A hinge-latch assembly as defined in claim 6 wherein said assembly includes a pair of said elongate guide rails and said hinge plate includes a pair of channels for receiving said guide rails therein.

8. A hinge-latch assembly for mounting an extension leaf to a table top and the like for selectively retaining the extension leaf in a storage position beneath and parallel to the undersurface of the table top or in an extended position substantially co-planar with the table top, said hinge-latch assembly comprising:

an elongate guide rail;

means for mounting said guide rail to the undersurface of a table top adjacent and substantially perpendicular to an edge of a table top;

a generally flat hinge plate slidably mounted on said guide rail for movement along the undersurface of the table top between a retracted position and a non-retracted position, wherein said hinge plate projects beyond the edge of the table top when said hinge plate is in said non-retracted position and wherein said end of said hinge plate does not project beyond the edge of the table top when said hinge plate is in said retracted position, said hinge plate having a channel for receiving said guide rail therein;

pivot means rotatably mounted to one end of said hinge plate, means for also mounting said pivot means to an extension leaf to provide pivotal movement of the extension leaf through substantially 180° of arc relative to said hinge plate, whereby the extension leaf is maintained in said storage position;

said pivot means including an elongate hinge bar mounted to said hinge plate for rotation in a plane oriented substantially perpendicularly to the plane of said hinge plate;

said hinge bar being rotatable from one position substantially co-planar with said hinge plate, to another position substantially co-planar with said hinge plate, to pivot the extension leaf from said storage position to said extended position; and latching means for selectively retaining the extension leaf in said extended position.

9. A hinge-latch assembly as defined in claim 8 wherein said hinge bar engages the undersurface of the table when said hinge plate is in said retracted position to restrict rotation of said hinge bar and thereby maintain the extension leaf in said storage position.

10. A hinge-latch assembly as defined in claim 9 wherein said pivot means include a pair of said hinge bars.

11. A hinge-latch assembly as defined in claim 10 wherein said latching means include an elongate latch bar adapted for mounting to the extension leaf for sliding movement relative thereto between a latched position, in which a portion of said latch bar extends under and engages the edge of the table top, and an unlatched position wherein said latch bar does not extend under the edge.

12. A hinge-latch assembly as defined in claim 11 wherein said mechanism includes a pair of said elongate guide rails and said hinge plate includes a pair of channels for receiving said guide rails therein.

* * * * *